United States Patent [19]

Kawanaka et al.

[11] 4,144,176

[45] Mar. 13, 1979

[54] FIBER-TREATING AGENT

[75] Inventors: Hideo Kawanaka, Osaka; Toshio Sato, Wakayama; Yosihiko Kasahara, Kainan, all of Japan

[73] Assignee: Kao Soap Co., Ltd., Tokyo, Japan

[21] Appl. No.: 919,933

[22] Filed: Jun. 28, 1978

[30] Foreign Application Priority Data

Jul. 1, 1977 [JP] Japan ..... 52/78612

[51] Int. Cl.[2] ..... D06M 13/26

[52] U.S. Cl. ..... 252/8.7; 252/555; 428/394; 8/115.6

[58] Field of Search ..... 252/8.7, 555; 8/115.6; 428/394

[56] References Cited

U.S. PATENT DOCUMENTS

| | | | |
|---|---|---|---|
| 2,638,445 | 5/1953 | Young et al. | 252/8.7 |
| 3,275,672 | 9/1966 | Kuhne et al. | 252/8.7 |
| 3,776,861 | 12/1973 | Mausner et al. | 252/555 |
| 3,812,060 | 5/1974 | Alsbury | 252/555 |
| 3,883,583 | 5/1975 | Nagayama et al. | 252/8.7 |
| 3,965,014 | 6/1976 | Giordano et al. | 252/8.7 |

*Primary Examiner*—William E. Schulz

*Attorney, Agent, or Firm*—Blanchard, Flynn, Thiel, Boutell & Tanis

[57] ABSTRACT

Fibers can be effectively treated with a composition containing αolefinsulfonic acid salts having not less than 20 carbon atoms.

4 Claims, No Drawings

FIBER-TREATING AGENT

BACKGROUND OF THE INVENTION

1. Field of the Invention

The present invention relates to a fiber treating agent. More particularly, the present invention relates to a fiber treating agent containing α-olefinsulfonic acid salts to be used as an aqueous fiber treating agent such as emulsifier, softening agent, smoothing agent or sizing agent in fiber preparation step and finishing process.

The softening agent, smoothing agent or sizing agent imparts smoothness, convergency or softness to fibers in spining step or weaving step to prevent the fibers from demage by an external force applied to the fibers in the step. Those fiber treating agents adhere to the fiber surface adsorptively in a layer to exhibit their effects. The fiber treating agents are used in the form of an aqueous solution, dispersion or emulsion in the step of application to the fiber surface.

2. Description of Prior Arts

Various surfactants have been used heretofore as fiber treating agents in the preparation of fibrous products. As the surfactants, there may be mentioned alkylbenzene sulfonates, alkyl sulfates, alkyl phosphates, fatty acid soaps, dialkyl sulfosuccinates, paraffin sulfonates and animal and vegetable oil-sulfuric acid esters.

Properties indispensible for the softening agent, smoothing agent or sizing agent are high softening capacity, water-solubility, smoothing property and capacity of emulsifying waxes. However, the alkylbenzene sulfonates, alkyl sulfates and paraffin sulfonates have poor softening effect and insufficient power of emulsifying waxes. The fatty acid soaps and dialkyl sulfosuccinates are lacking in water-solubility, though they have a softening effect. The alkyl phosphates have insufficient softening capacity and water-solubility and they are lacking in wax-emulsifying power. Thus, only sulfated sperm oil satisfies all requirements of softening effect, water-solubility and emulsifying power.

Unlike other animal or vegetable oils, the sperm oil comprises not gylcerol ester but higher alcohol/fatty acid esters. Therefore, the sperm oil has excellent properties such as emulsifying and lubricating properties. The sperm oil has been used broadly in fiber industry.

However, recently, the problem of whaling is discussed as an issue of international importance. A measure of capture restriction was taken from viewpoint of protection of natural resources or animal preservation. Under the circumstances as above, the use of sperm oil as an industrial raw material becomes difficult.

Further, since sperm oil is a natural product, it is difficult to obtain sperm oil of a uniform quality and there are problems of discoloration or offensive smell probably due to highly unsaturated compounds contained therein. Sperm oil sulfate has a demerit that coloring in sulfation step is unavoidable owing to higly unsaturated compounds contained therein which causes coloring of cloths to be treated and an offensive smell.

SUMMARY OF THE INVENTION

After intensive investigations on a new anionic surfactant as a substitute for sulfated sperm oil under the circumstances as above, the inventors have found that α-olefin of more than 20 carbon atoms inclusive, preferably 20–30 carbon atoms, and neutralizing the resulting sulfonate fit the purpose.

The present invention relates to a fiber treating agent containing α-olefin sulfonic acid salts of more than 20 carbon atoms inclusive, preferably 20–30 carbon atoms.

As the α-olefin sulfonic acid salts according to the present invention, there may be mentioned alkali metal salts such as sodium and potassium salts and ammonium salts thereof.

A process for preparing the α-olefin sulfonic acid salt according to the present invention comprises heating α-olefins containing 20 or greater carbon atoms inclusive, preferably 20–30 carbon atoms, to a temperature above 40° C. previously, contacting the same with $SO_3$ gas to obtain α-olefin sulfonates, heating the sulfonates to a temperature above 50° C., neutralizing the same with a caustic alkali solution, and then heating the same to a temperature above 80° C., preferably above 130° C. and hydrolyzing the same to obtain the intended product.

The α-olefin sulfonic acid salts according to the present invention are dispersible anionic surfactants of a Krafft point of 50°–55° C. which can be used as processing acids of textile such as fiber softening and smoothing agent.

The fiber treating agents of the present invention are free of defects of whale oil sulfate such as coloring property and an offensive smell and, in addition, they have very excellent softening capacity, hand and smoothing property. It is considered that those effects are due to the characteristic structure of the fiber treating agent of the present invention, i.e. due to the fact that the fiber treating agent comprises very long chain α-olefin sulfonates.

The α-olefins used in the present invention are preferably those of 20–30 carbon atoms, particularly those having the following composition:

| Carbon number of α-olefin | α-Olefin content |
|---|---|
| 20 | 25–35 wt. % |
| 22 | 20–30 |
| 24 | 15–25 |
| 26 | 10–20 |
| 28 | 5–15 |
| 30 | 0–5 |

According to this invention, the fiber treating composition contains from 1 to 80 weight percent of alpha-olefin-sulfonic acid salts. In detail, this invention provides the following compositions to be used in various applications. When the composition of this invention is used as a softening agent for fibers, it comprises from 1 to 80 weight percent, preferably from 5 to 30 wt.%, of alpha-olefinsulfonic acid salts, from 3 to 70 weight percent, preferably from 5 to 30 weight percent, of a softening base and up to 10 weight percent, preferably from 1 to 5 weight percent, of another emulsifier, especially nonionic surfactant. The softening agent works to impart softness to fibers as the primary ingredient and includes oil and fats such as fatty acid glycerides, that is, polyhydric alcohol esters of fatty acids having at least one alkyl group of 10 or above carbon atoms, such as beef tallow, especially hardened beef tallow, rape seed oil, coconut oil, monoglyceride stearate, propyleneglycol stearate, sorbitan monostearate and sorbitan trioleate; urea buret-cross linked compounds of 10 or below carbon atom having polyalkylenepolyamine containing 10 or above carbon atoms having alkyl groups and salts thereof with an organic acid or mineral acid, such as

SBN: $RCONHC_2H_4-N(C=O)-C_2H_4NHCOR$
$RCONHC_2H_4-N(C=O)-C_2H_4NHCOR$ wherein R is an alkyl having 17 carbon atoms, and

SAB: $RCONHC_3H_6-N(C=O)-C_3H_6OH$
$RCONHC_3H_6-N(C=O)-C_3H_6OH$ wherein R is an alkyl having 17 carbon atoms; higher aliphatic alcohols having 5 or above carbon atoms and ethylene oxide adduct thereof having 5 or above moles of added ethylene oxide units, such as stearyl alcohol and adduct of stearyl alcohol and 4 moles of ethylene oxide; and adducts of an aliphatic acid having from 8 to 20 carbon atoms and not more than 30 moles of ethylene oxide, such as castor oil-ethylene oxide (25 moles) adduct and ethylene oxide adduct of beef tallow glycerin.

Then, the composition can be used as a smoothing agent, oiling agent or fiber lubricant, comprising from 3 to 80 weight percent, preferably from 5 to 20 weight percent, of alpha-olefinsulfonic acid salts, from 3 to 95 weight percent, preferably from 5 to 90 weight percent, of a smoothing agent and from 1 to 20 weight percent, preferably from 3 to 10 weight percent, of another emulsifier, especially nonionic surfactant. Furthermore, this composition can be combined with from 1 to 50 weight percent, preferably from 5 to 50 weight percent, based on the weight of the above composition, of the above mentioned softening base in order to strengthen the softness. As the smoothing agent, there may be used paraffins, especially those having a melting point of 100° F. or lower; natural wax such as carnauba wax, bees wax, montan wax, haze tallow, wool wax and polyethylene wax; and amide wax such as stearic amide and ethylenediamine distearylamide.

In the above two compositions, another emulsifiers to be used there include nonionic surfactants having an HLB value of from 7 to 19, such as oleyl alcohol adduct of 30 moles of ethylene oxide and sorbitan polyoxyethylene (20 moles) stearate.

Next, the composition can be used as a sizing agent, comprising from 1 to 20 weight percent of a starch base from 0.5 to 10 weight percent, preferably from 1 to 5 weight percent, of alpha-olefinsulfonic acid salts. Alternatively, the above mentioned softening agent can take place of alpha-olefinsulfonic acid salts in an amount of from 0.5 to 10 weight percent, preferably from 1 to 5 weight percent. As the starch base, there may be used polyvinyl alcohol, polyacrylic acid-ethylene oxide adduct, methyl cellulose, carboxymethyl cellulose, ethylcellulose, starch and hydroxyethyl starch.

The composition according to this invention may be used in the form of its aqueous emulsion, as seen in Examples.

The following examples further illustrate the present invention, which by no means limit the invention.

EXAMPLE 1

334 Grams of α-olefins of a carbon number distribution as shown below were heated to 50° C. to melt. Then, the α-olefins were reacted with $SO_3$ gas (corresponding to 80 g of $SO_3$) at 72° C. for two minutes. The resulting sulfonate (acid value: 68) was added to an aqueous caustic soda solution containing 41 g of caustic soda. Solid content was 17%. Hydrolysis was effected in an autoclave at 150° C. for 30 minutes to obtain sodium α-olefin sulfonates:

| Carbon number | α-Olefin content | pH=10 (NaOH neutralization) |
|---|---|---|
| 20 | 29 wt. % | |
| 22 | 25 | |
| 24 | 19 | |
| 26 | 15 | |
| 28 | 9 | |
| 30 | 3 | |

With thus obtained sodium α-olefin sulfonates (product of the present invention) and ordinary anionic surfactants, cotton hosiery, cotton thread, cotton toweling and cotton flannel were treated and hands of them were compared with one another by organoleptic tests to obtain the results shown in Table 1. Treating conditions)

10 g/l. Solution of each surfactant was prepared. The samples were immersed in the solution at room temperature for 10 minutes and then dehydrated to a squeezing rate of 120–130% by using a mangle for cloths and a centrifugal separator for the thread. The samples were dried at 100° C. for one hour and then air-conditioned at 20° C. under a relative humidity (RH) of 65% for 24 hours. Thereafter, the samples were subjected to organoleptic appraisal.

Table 1

| Anionic surfactant | Hand* | | | |
|---|---|---|---|---|
| | Cotton hosiery | Cotton thread | Toweling | Flannel |
| Paraffin sulfonates | −− | − | −− | −− |
| Cetyl alcohol sulfate | − | + | − | −− |
| Sulfated sperm oil | Control | Control | Control | Control |
| Treating agent of the invention | ++ | ++ | ++ | ++ |

*Sulfated sperm oil was used as control.
Judgement:
++: Softer than control
+: Slightly softer than control
±: Softness equal to that of control
−: Slightly harder than control
−−: Harder than control As indicated by Table 1, the treating agent of the present invention exhibits an excellent softening property.

EXAMPLE 2

Generally, in anionic softening agents, fatty acid esters of polyhydric alcohols and anionic surfactants having softening property are used together.

As the anionic softening agents to be used for this purpose, particularly softening agents for cotton materials, softening agents comprising 75 wt. % of polyhydric alcohol fatty acid esters and 25 wt. % of various anionic surfactants were compared with one another with respect to softening properties. The results are shown in Table 2.

In this example, sorbitan monostearate [Span 60 (a product of Kao Atlas Co.)] was used as polyhydric alcohol fatty acid ester. Treating condition 2 g/l. Solution of each softening agent was prepared. The cloth samples were immersed in the solution at room temperature for 10 minutes and then squeezed with a mangle.

As the samples, cotton broad cloth #40 and toweling were used. Squeezing rates were 12% for the cotton broad cloth #40 and 130% for the toweling.

Drying was effected at 100° C. for one hour and humidity control conditions were the same as in Example 1.

Hand was judged in the same manner as in Example 1.

Table 2

| Anionic surfactant | Hand | | | |
|---|---|---|---|---|
| | Cotton broad cloth #40 | | Toweling | |
| | Softness | Sliminess | Softness | Sliminess |
| Paraffin sulfonates | − | − | ± | ± |
| Cetyl alcohol sulfate | − | − | −− | − |
| Sulfated oleic acid ester | + | − | + | ± |
| Sulfated sperm oil | Control | Control | Control | Control |
| Treating agent of the invention (obtained in Example 1) | ++ | ++ | ++ | + |

Table 2 shows that the treating agent of the present invention exhibits an excellent softening property and it does not quench fluorescent dyes.

EXAMPLE 3

Treating agents for softening and smoothing fibers are used in two ways. Namely, woven fabrics are treated with them to impart softness thereto or alternatively, they are used for imparting smoothness to the fibers to ben knitted.

Recently, cheese dyeing machine has been well-developed. Oils are fed in cheese-like form before the knitting step.

As softening and smoothing agents for this purpose, anionic softening and smoothing agents and cationic softening and smoothing agents are used. In case a fluorescent dye is used, an anionic softening and smoothing agent is employed.

The anionic softening and smoothing agents used for such cheese oiling step, the following emulsified, high melting point wax is used in general:

| Recipe) | |
|---|---|
| Paraffin wax | 5 wt. % |
| Amide wax | 10 |
| Nonionic emulsifier | 2 |
| Fatty acid salt | 4 |
| Anionic surfactant | 4 |
| Water | 75 |

Polyester/cotton mixed thread as subject was treated with a smoothing agent of the above composition in a cheese dyeing machine so that 0.5%, based on the fibers, of 5 g/l. aqueous solution of the smoothing agent would be absorbed by the thread. The thread was dried at 80° C. for one hour.

Results of appraisal of smoothing properties of various anionic surfactants according to the above recipe were as shown in Table 3.

Table 3

| Anionic surfactant | Interweaving resistance* (g) |
|---|---|
| Paraffin sulfonate | 130 g |
| Cetyl alcohol-sulfuric acid ester salt | 125 g |
| Sulfated sperm oil | 125 g |
| Treating agent of the invention (obtained in Example 1) | 110 g |
| No surfactant | 172 g |

*Method of determination of interweaving resistance

Three knitting needles were set on a friction part of a μMeter (a product of Eiko Sokki Co., Ltd.). Sum of abrasion resistance at various thread velocities of 10, 50, 100, 150 and 200 m/min. between the thread and a hook part is shown.

The lower the knitting resistance value is, the easier the loop formation in the knitted cloth is and, therefore, the better the knitted goods is produced.

EXAMPLE 4

Softening and smoothing agents are used also in weaving step in addition to said knitting step. In this case, the softening and smoothing agent is added to a sizing agent in sizing step to improve smoothness of the weave in the woven fabric.

The softening and smoothing agents used for this purpose should be compatible with a sizing agent and should not reduce membrane strength of the sizing agent.

For examining influences of the treating agents on the membrane of sizing agent, a sizing agent was combined with a softening and smoothing agent, a membrane was formed from the mixture and transmission rate of the membrane was determined.

As sizing agents, polyvinyl alcohol sizing agents and acryl sizing agents were selected. Gosenol GL 05 was employed as the former and Merposol S-50 was employed as the latter. 10% Solution of each of the sizing agents was added with 1% of an anionic surfactant and the mixture was poured in a Petri dish of a diameter of 40 m/mϕ in a thickness of 5 mm. The same was dried in an ignition dryer at 105° C. for 5 hours to form a membrane. Rate of transmission of the membrane was determined. The results are shown in Table 4.

Table 4

| Anionic surfactant | Rate of transmission* | | Remarks |
|---|---|---|---|
| | Gosenol GL-05 | Merposol S-50 | |
| C16-18 α-Olefin sulfonates | 91% | 84% | Control |
| α-Olefin sulfonates (C20–C30) obtained in Example 1 | 98% | 94% | Treating agent of the invention |
| No surfactant | 100% | 100% | |

*Method of determination of rate of transmission:

A Poick turbidimeter of integrating sphere system (TYPE SET-PT, a product of Nihom Seimitsu Kogaku Co., Ltd.) is used. A membrane is placed in an optical path. Percentage transmission, on based on rate of a membrane containing no surfactant, of each sample was determined.

As shown in Table 4, as compared with the control, the treating agent of the present invention has a higher rate of transmission and it is an excellent base of softening and smoothing agent for threads to be used with a sizing agent.

EXAMPLE 5

In another case, a high melting point wax is emulsified and used for treatment of fibers. For example, a smoothing agent for weaving used in the preparation of bath towels belongs to this group. Also in this case, the treating agent of the present invention exhibits more excellent properties than control.

60 Parts by weight of a high melting point wax were combined with 40 parts by weight of an anionic surfactant. Emulsion stability of the mixture was examined to obtain the results shown in Table 5.

Table 5

| Subject to be emulsified | Anionic surfactant (α-olefin sulfonates) | |
|---|---|---|
| | $C_{16}$ -0 $C_{18}$ | Obtained in Example 1 ($C_{20}$ - $C_{30}$) |
| Amide wax | Poor emulsification | Good emulsification |
| Distearyl-hydroxy-methane | Poor emulsification | Good emulsification |
| Distearyl-ketone | Poor emulsification | Good emulsification |
| Remarks | Control | Treating agent of the invention |

The treating agent of the present invention shown in Table 5 has higher emulsifying power than that of the control. The former is useful as a base of smoothing agent for fibers.

Significant differences were recognized between the treating agent of the present invention and controls as shown in Table 6.

Table 6

| Item | | α-Olefin sulfonates | | Sulfated sperm oil |
|---|---|---|---|---|
| | | $C_{16}$ - $C_{18}$ | $C_{20}$ - $C_{30}$ | |
| Smoothness of treated cotton thread (initial load 15g) | 50 m/min | 62 g | 60 g | 64 g |
| | 100 m/min | 67 g | 64 g | 72 g |
| | 150 m/min | 70 g | 65 g | 76 g |
| | 200 m/min | 73 g | 67 g | 81 g |
| Inter-weaving property | Tension of thread | 1.8–7.4 g | 1.6–5.9 g | 1.9–8.2 g |
| | Knitting length | 12.3 cm | 12.8 cm | 11.4 cm |

As compared with $C_{16}$–$C_{18}$ α-olefin sulfonates (control) used as a raw material of detergents and sulfated sperm oil (raw material of fiber treating agent), the treating agent of the present invention has very excellent properties as softening and smoothing agent.

EXAMPLE 6

The treating agent of the present invention was compared with surfactants used for ordinary fiber treating agents with respect to color and smell to obtain the results shown in Table 7.

Table 7

| | Color* (Gardner) | Smell |
|---|---|---|
| Paraffin sulfonates | Below 1 | None |
| Cetyl alcohol sulfate | 1 | Mild |
| Sulfated oleic acid ester | 5 | Smell of rice bran oil |
| Sulfated sperm oil | 6 | Fishy putrid smell |
| Treating agent of the invention (Obtained in Example 1) | 1 | Mild |

*Gardner colorimetry:
Samples were examined in comparison with colorless ($G_1$) -dark brown (G18) standard color samples. Colors of the samples were shown by Gardner numbers of the standard color samples of equal colors.

What is claimed is:

1. A composition of fiber treating agent containing α-olefinsulfonic acid salts of 20 or above carbon atoms inclusive.

2. A composition of fiber treating agent according to claim 1 wherein the α-olefinsulfonic acid salts contain 20–30 carbon atoms.

3. A composition of fiber treating agent according to claim 1 wherein the α-olefinsulfonic acid salts are sodium potassium or ammonium salts.

4. A composition of fiber treating agent according to claim 2 wherein the α-olefinsulfonic acid salts have the following carbon number distribution of the α-olefins:

| Carbon number of α-olefins | α-olefin content |
|---|---|
| 20 | 25–35 wt.% |
| 22 | 20–30 |
| 24 | 15–25 |
| 26 | 10–20 |
| 28 | 5–15 |
| 30 | 2– 5 |

* * * * *

UNITED STATES PATENT AND TRADEMARK OFFICE

CERTIFICATE OF CORRECTION

PATENT NO. : 4 144 176

DATED : March 13, 1979

INVENTOR(S) : Hideo Kawanaka et al

It is certified that error appears in the above-identified patent and that said Letters Patent are hereby corrected as shown below:

Column 8, line 34; before "potassium" insert a comma (,).

Column 8, Claim 4, last entry in the second column of the table; change "2-5" to ---0-5---.

Signed and Sealed this

*Thirty-first* Day of *July 1979*

[SEAL]

*Attest:*

*Attesting Officer*

LUTRELLE F. PARKER

*Acting Commissioner of Patents and Trademarks*